US008424222B2

(12) United States Patent
Sulak et al.

(10) Patent No.: US 8,424,222 B2
(45) Date of Patent: Apr. 23, 2013

(54) ARTHRITIS AND DIABETES INSOLE

(75) Inventors: Duane M. Sulak, Waco, TX (US); David B. Granger, Lorena, TX (US); Jacob Martinez, Temple, TX (US)

(73) Assignee: Spenco Medical Corporation, Waco, TX (US)

( * ) Notice: Subject to any disclaimer, the term of this patent is extended or adjusted under 35 U.S.C. 154(b) by 582 days.

(21) Appl. No.: 12/672,260

(22) PCT Filed: Nov. 21, 2008

(86) PCT No.: PCT/US2008/084280

§ 371 (c)(1), (2), (4) Date: Feb. 4, 2010

(87) PCT Pub. No.: WO2009/067643

PCT Pub. Date: May 28, 2009

(65) Prior Publication Data

US 2011/0219642 A1 Sep. 15, 2011

Related U.S. Application Data

(60) Provisional application No. 60/989,767, filed on Nov. 21, 2007.

(51) Int. Cl.
*A43B 13/38* (2006.01)

(52) U.S. Cl.
USPC ..... 36/44; 36/174; 36/178; 36/181

(58) Field of Classification Search ..... 36/44, 174, 36/178, 181, 28, 43, 145, 166, 173, 91
See application file for complete search history.

(56) References Cited

U.S. PATENT DOCUMENTS 4,413,429 A * 11/1983 Power ..... 36/44
4,887,368 A * 12/1989 Latzke ..... 607/111
6,176,025 B1 * 1/2001 Patterson et al. ..... 36/28
6,453,578 B1 9/2002 Yung et al.
6,481,120 B1 11/2002 Xia et al.
(Continued)

FOREIGN PATENT DOCUMENTS

KR 10-0641278 11/2006
KR 10-0736813 7/2007

*Primary Examiner* — Ted Kavanaugh
(74) *Attorney, Agent, or Firm* — Hemingway & Hansen, LLP; D. Scott Hemingway

(57) ABSTRACT

An insole especially advantageous for arthritic or diabetic patients comprises three layers and is shaped in a form which provides and arch support and an integral heel receiving area. It is made from a generally foot-shaped bottom layer having a length extending from a heel area to a toe area, a top surface and a bottom surface. The bottom surface of the bottom layer preferably further comprises one to three indentations formed integrally therein. Insert layers are secured to each of said indentations. Preferably, the bottom layer is made from an EVA foam. A middle layer having a first and second side is secured to the top surface of the bottom layer adjacent the middle layer's second side. The middle layer is preferably made of a synthetic rubber layer. The middle layer takes the shape of the bottom layer. A top layer is coextensive with and secured to the first side of the synthetic rubber layer. The top layer composition is selected according to the intended use. In use, the foot of the wearer, with or without a sock or stocking thereon, rests upon the top layer in the foot-receiving compartment of the shoe.

17 Claims, 6 Drawing Sheets

U.S. PATENT DOCUMENTS

| | | | | |
|---|---|---|---|---|
| 6,684,532 | B2 * | 2/2004 | Greene et al. | 36/28 |
| 6,915,598 | B2 | 7/2005 | Grisoni et al. | |
| 6,959,505 | B2 * | 11/2005 | Poe | 36/43 |
| 7,284,342 | B2 | 10/2007 | Avent et al. | |
| 7,484,319 | B2 * | 2/2009 | Cheskin et al. | 36/44 |
| 7,900,380 | B2 * | 3/2011 | Rich | 36/154 |
| 2003/0009915 | A1 * | 1/2003 | Bacon | 36/44 |
| 2005/0138847 | A1 * | 6/2005 | Blackburn et al. | 36/73 |
| 2007/0084084 | A1 * | 4/2007 | Rich | 36/44 |
| 2007/0261268 | A1 * | 11/2007 | Nguyen | 36/44 |

* cited by examiner

ARTHRITIS AND DIABETES INSOLE

CROSS REFERENCE TO RELATED APPLICATIONS

This application claims the benefit of U.S. Provisional Patent Application 60/989,767, filed 21 Nov. 2007.

STATEMENT REGARDING FEDERALLY SPONSORED RESEARCH OR DEVELOPMENT

Not applicable.

TECHNICAL FIELD

This invention relates to the field of replacement insoles for shoes.

BRIEF DESCRIPTION OF THE DRAWINGS

FIGS. 2A-7A represent the same views as FIGS. 2-7, except that they illustrate embodiments described herein which have a thicker top layer.

DETAILED DESCRIPTION

Figure 1:
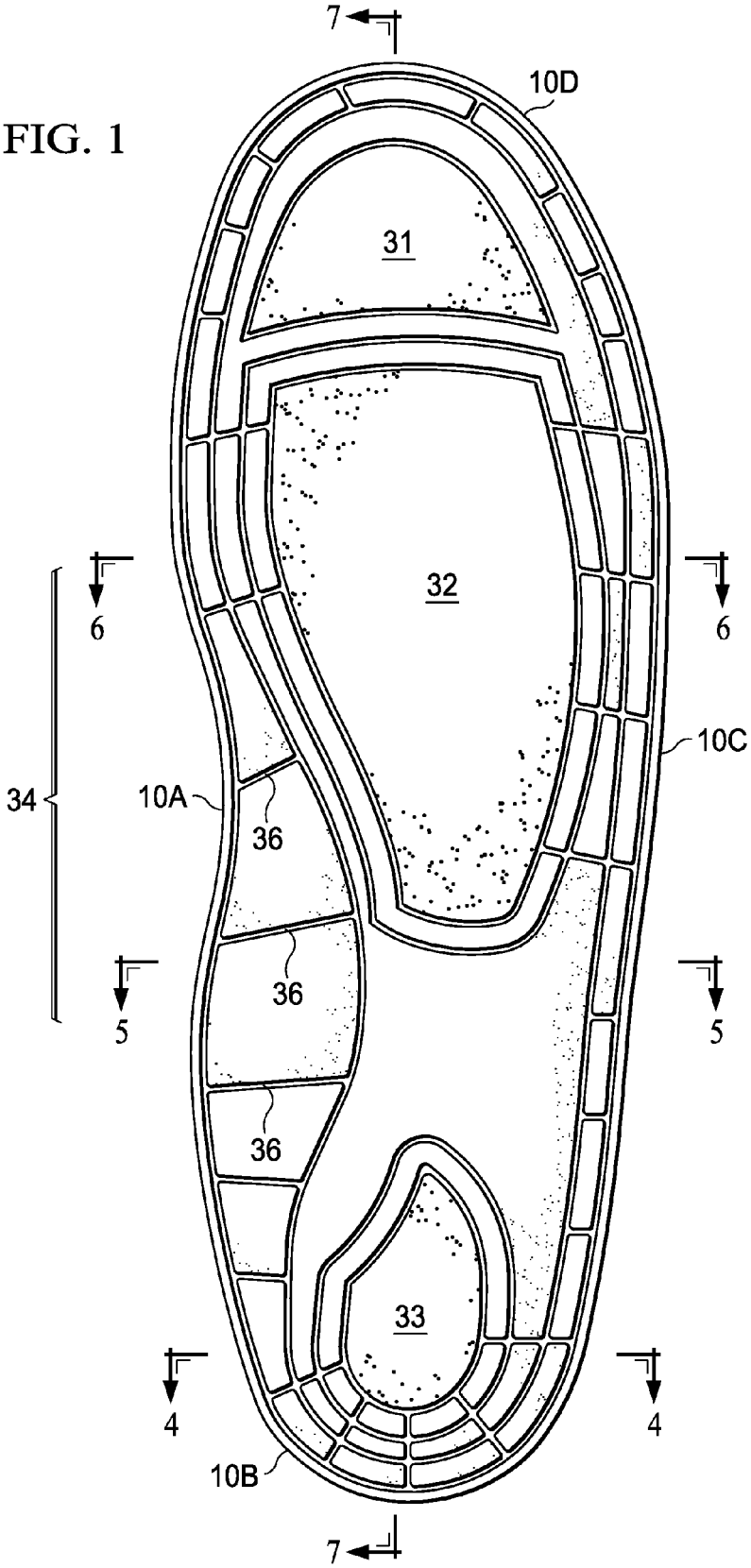
FIG. 1 is a bottom view of an insole for the left shoe of the preferred embodiment of the present invention.

An insole advantageous for users afflicted with arthritic, diabetic, and other conditions is disclosed that advantageously absorbs shock and provides support to areas of the feet most subject to increased force or pressure during standing, walking or other activities. For convenience, the insole of the invention disclosed herein will be referred to as "the insole".

The insole is formed in a shape which receives and supports the foot of the wearer. It has an inner side and an outer side. The outer side will lie adjacent the outer outline of a user's foot in use and the inner side will lie adjacent the inner side of a user's foot in use, including the arch of the foot. Accordingly, the formed shape includes an integrally formed arch support which extends generally upwardly on the inner side of the insole. This upward extension allows the arch support to lie adjacent to a user's foot arch during wearing.

The insole comprises at least three coextensive layers adjacent one another and extending the length of the insole, a middle layer, a bottom layer, and a top layer to be discussed later. Each of said layers is included in the formed shape.

In the preferred embodiment, the top layer mentioned in paragraph 14 is constructed of polyethylene foam having a thickness of about 2 mm. In this embodiment, the insole is most advantageous for use by persons with arthritis.

In a second alternate embodiment, the top layer mentioned in paragraph 14 is constructed of closed-cell cross-linked polyethylene foam material having a thickness of from about 2.5 mm to from about 3.8 mm, preferably about 3.2 mm. In this embodiment, the insole is most advantageous for use by persons with diabetes. An insole appropriate for use by diabetic patients utilizes the same basic design as the arthritic insole, except that the top layer comprises a closed cell cross-linked polyethylene foam material. Preferably, this material has an ASKER value of about 30 ASKER C±3 and meets governmental regulation for diabetic insoles A5510 (direct formed, compression molded to patient's foot without external heat source, multiple density insert prefabricated, per shoe)

One suitable material for the diabetic insole top layer is Plastazote® closed cell cross-linked foam material available from Zotefoams PLC. (United Kingdom). This type of foam provides for total contact with the foot. The top layer is preferably about 2.5 to 3.8 mm thick. Most preferred, the top layer is about 3.2 mm thick. Upon contact with the foot of a user, the top layer will permanently conform thereto. Other materials can be used as long as they provide for total contact with the patient's foot.

In a third alternate embodiment, the top layer mentioned in paragraph 14 is constructed of a thin fabric layer. In this embodiment, the insole is most advantageous for use by persons with arthritis.

The bottom layer has a shoe side surface which further comprises one or more indentations adapted to receive an insert layer, and an insert layer attached to each of said indentations.

The bottom layer preferably comprises a durable material which will provide a semi-rigid structure to the insole. A preferred material used for the bottom layer is an Ethylene Vinyl Acetate (EVA) foam material. Other materials can be used as long as they have the durability needed and which can be compression molded. The preferred EVA material of the bottom layer and inserts has a relative ASKER C hardness of 51±3.

EVA or other appropriate materials can be shaped into a dimensional article by compression and heat. In this way, the preferred embodiment having an arch support integral with the insole, but rising upwardly from a relatively planar surface on which most of the weight of a user's foot is intended to rest, and an integral heel-receiving area can be formed in the insole.

The bottom layer has a shoe-side surface which is intended to rest adjacent in the foot-receiving compartment of a shoe. The shoe side surface preferably further comprises one or more indentations each adapted to receive an insert layer. The indentations may be formed by providing a positive area in a mold which will create the indentation. Preferably, a heel indentation is in the heel area. A toe indentation may be provided in the toe area. A third indentation may be provided in the metatarsal area and this may extend to the arch area. Any combination of these indentations may be provided in an insole, for example toe and heel, heel and metatarsal, toe, heel and metatarsal. Preferably, the insole comprises a toe indentation, a heel indentation, and a metatarsal indentation.

Inserts are secured to each of the indentations. Each insert preferably comprises an EVA foam material. Preferably, the inserts have a texture which provides a gripping feature to aid in positioning and gripping to the inside of a shoe in which it is intended to be inserted by the wearer so that little or no slipping of the insole will occur during use. The texture is provided by features on the mold.

The inserts are placed in areas of high stress. The heel insert is positioned in the heel area to provide cushioning to the heel area of the foot of a user at heel strike. Another may be placed within the metatarsal area extended to the arch area to receive metatarsal impact and to provide support. The toe insert is placed in the toe area to assist in cushioning during toe impact.

Preferably, there is an insert-free area between the toe area and the metatarsal area. This permits the insole to flex in that area during a natural walking motion if the shoe also flexes and provides rigidity to the arch of the insole.

The bottom surface further is preferably provided with a number of linear indentations which form ridges. These indentations provide flexibility.

The middle layer is comprised of a material that provides extra cushioning and support of the arthritic foot. In a preferred embodiment, the middle layer comprises a synthetic rubber. Most preferred are synthetic rubbers based on styrene butadiene or polychloroprene, which may be used to make sheets that can be die-cut in the shape of the insole. Neoprene brand polychloroprene synthetic rubber (DuPont Performance Elastomers, Wilmington, Del.) is an exemplary raw material for these types of sheets. SBR (styrene butadiene (synthetic) rubber) and CPR (chloroprene (synthetic) rubber) are synthetic rubbers used in the industry to make sheets known as synthetic rubber or neoprene sheets. Other materials can be used, but it is preferred that the material used has a value of approximately 21 ASKER C±5 to 30 ASKER C±5.

The top layer should be preferably secured by adhesive to the middle layer prior to die cutting the insole shapes.

Insole production can be accomplished by laminating together all materials into a die before shaping with heat and pressure. After the insole has been shaped in this fashion it is cut to its final shape. Alternatively, only middle and bottom layers may be produced in this way with later securement of the top layer.

As an example, approximate dimensions are given for a men's size 9 insole. Length and width of the insole are 11.063 inches and 3.813 inches. The total thickness of the insole can range from 0.256 inches near the toe area to 0.545 in the arch area. Arch height is about 1.476 inches. The thickness of each layer may vary, with the preferred thicknesses of about 2 millimeters for the middle layer and the thickness of the bottom layer varying, depending on its position of the insole. The inserts have a thickness of about 2 millimeters.

A view of the bottom (shoe side) of the insole is best seen in FIG. 1. FIG. 1 illustrates a left insole and it can be easily envisioned that a right insole would be a mirror image of the left insole illustrated. Insoles are generally sold and used in pairs, each pair comprising a right and a left insole. Outline (10) of the insole has been divided into outer region (10C), heel region (10B), inner region (10A) and toe region (10D).

Three inserts are shown secured to indentations in the bottom side of the bottom layer. The toe area insert (31) is secured near the front (toe) side of the insole. The metatarsal area insert (32) extends from just behind the toe area insert (31) towards the back (heel) end of the insole up to the arch region of the insole. The heel area insert (33) is secured near the back end of the insole. Each insert is shown exhibiting a different texture than the bulk of the insole bottom which will aid with traction in the shoe.

Cross sections along lines 4-4, 5-5, 6-6 and 7-7 will be discussed with respect to FIGS. 4-7. Ridges (36) are illustrated on the bottom of the arch support area (34). Numerous other ridges and lines are also visible.

Figure 2:
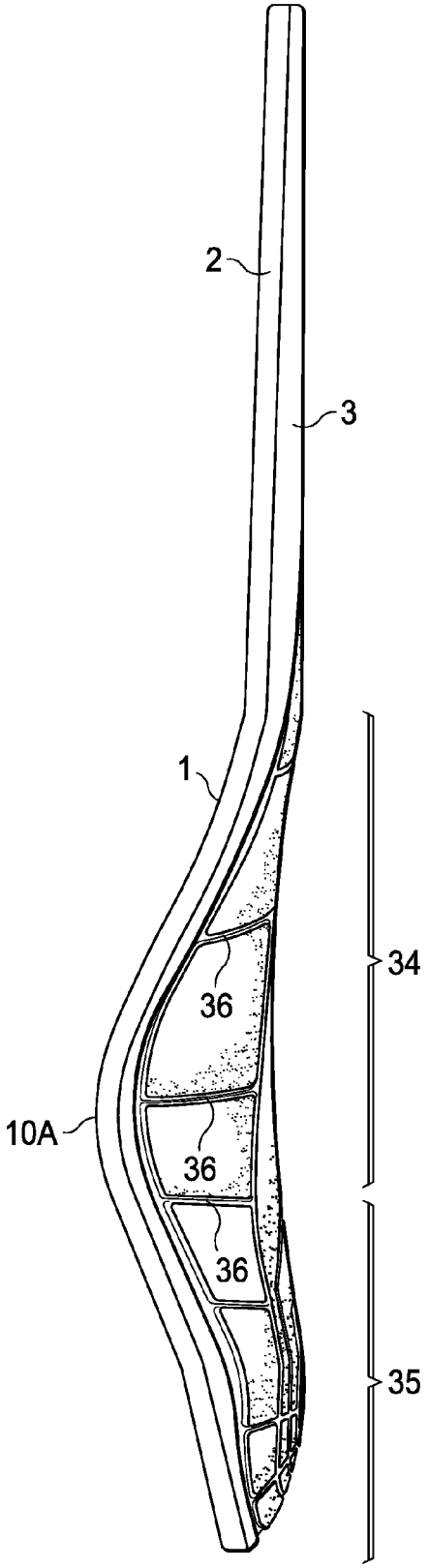
FIG. 2 is a perspective inner side view of the insole depicted in FIG. 1.
Figure 2A:
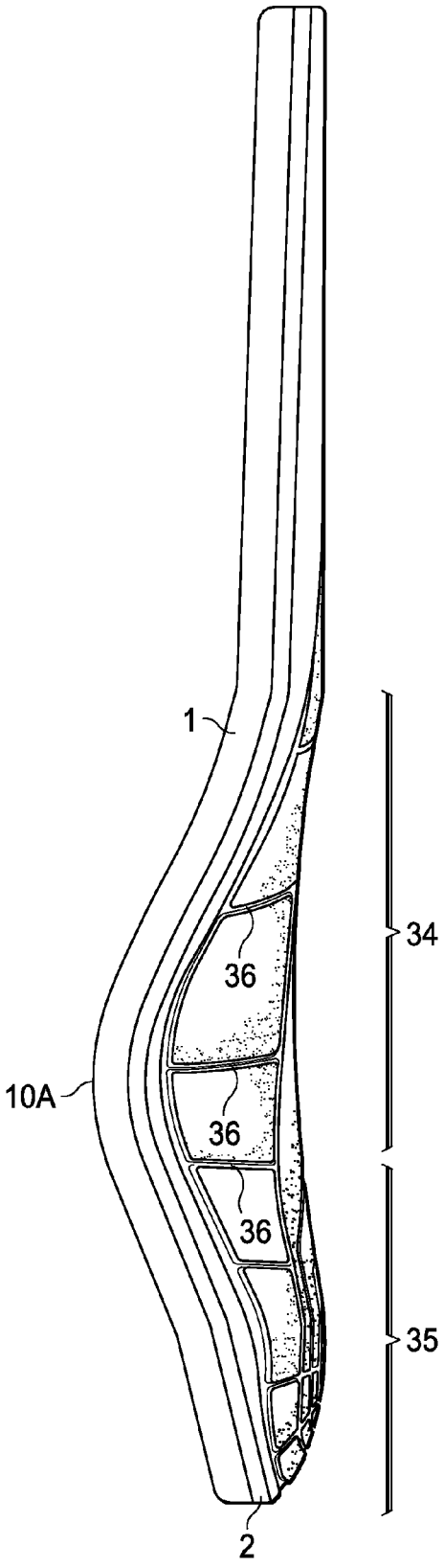

Referring to side view FIG. 2, from the inner outline region (10A) side of the insole of FIG. 1, arch support area (34) extends upwardly and one is able to see ridges (36) on the bottom side of the insole as well as fabric layer (1) and middle layer (2) from this view. Layer (1) is secured to a middle layer (2). Secured to the bottom (shoe) side of the middle layer (2) is a bottom layer (3). Referring to side view FIG. 2A, layer (1) is a foam layer.

The bottom layer (3) dictates the shape of the insole. The middle layer (2) and top cloth layer or foam layer(1) are sheets of material of uniform thickness that take on the shape determined by said bottom layer (3) when secured to one another and to said bottom layer (3).

Some key features found in the shape and design of the bottom layer (3) are the arch support (34) and heel area (35). The arch support area (34) extends upwardly from the rest of the insole and serves to provide added comfort and support for the arch of the foot. Heel area (35) appears as a cup or indented area and is adapted generally to receive the heel area of a user's foot. In this view the contour of heel area 35 is visible. The cup shape allows for extra comfort and security to the heel of the foot. Ridges (36) are also preferably employed to allow for better flexibility during use. The top layer thickness can vary from a thin cloth sheet to a foam layer of up to about 3.8 mm in thickness. Preferably, the top layer comprises foam and is of a thickness of from about 2.5 mm to from about 3.8 mm, preferably about 3.2 mm. The layer (1) as illustrated will appear thicker in relation to middle layer depending on the top layer selected. Most preferably, top layer (1) is a foam layer. In a less preferred embodiment top layer (1) is a thin cloth layer or a combination of a thin cloth layer and foam layer.

Figure 3:
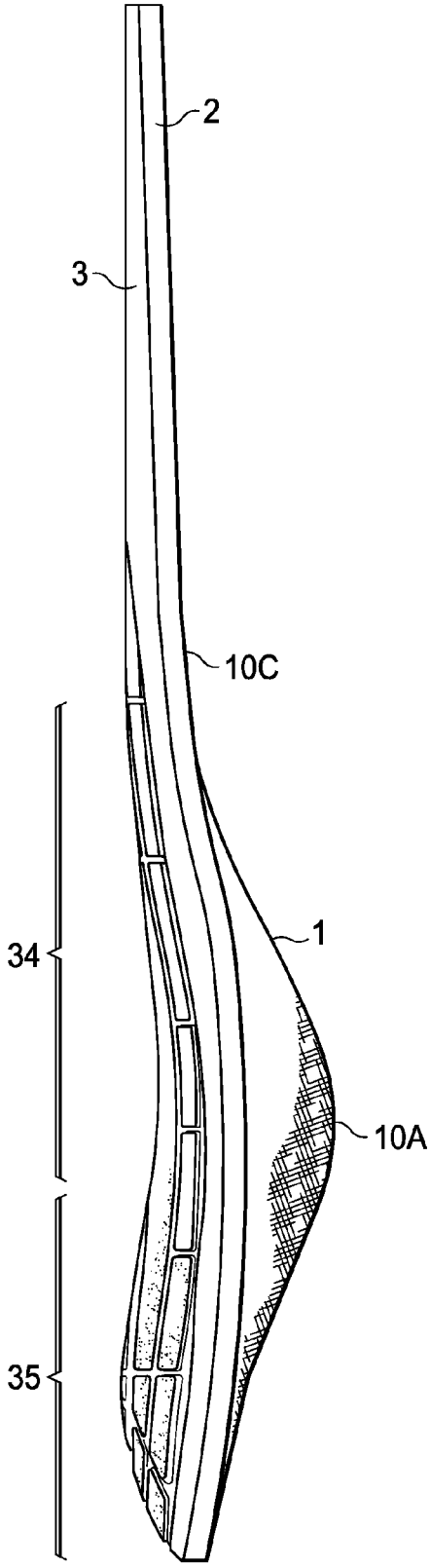
FIG. 3 is a perspective outer side view of one embodiment of the present invention.
Figure 3A:
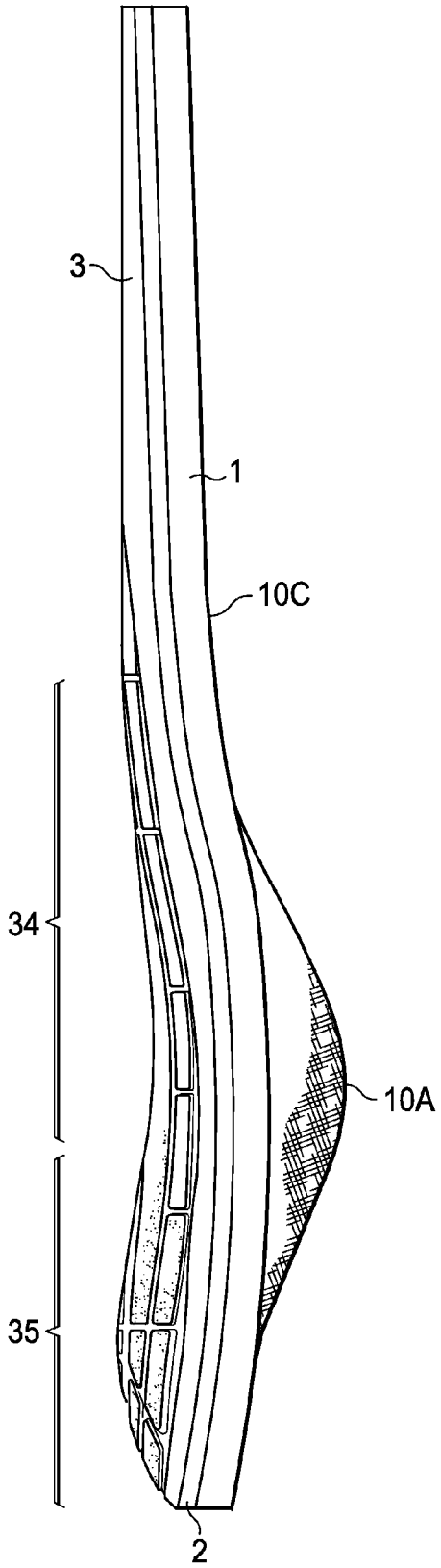

FIG. 3 and FIG. 3A shows a side view from outer outline region (10C). Because inner outline region (10A) extends upwardly, one can see it also from this view point, as well as top layer (1) covering the top of arch support area (34). Side views of middle layer (2) and bottom layer (3) are also visible. In FIG. 3 a thin layer which can be cloth or foam is illustrated. In FIG. 3A, a thicker foam layer is illustrated.

Figure 4:
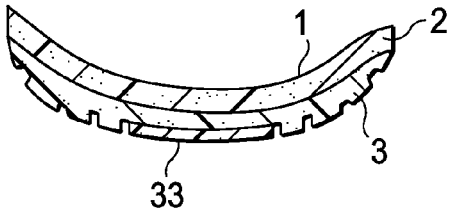
FIG. 4 is a cross-sectional view near the heel area along line 4-4 of FIG. 1.
Figure 5:
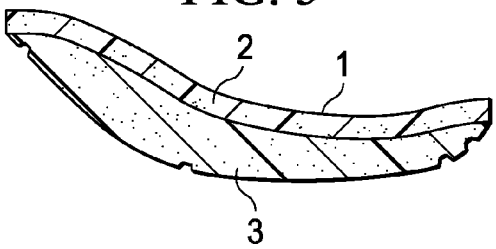
FIG. 5 is a cross-sectional view near the arch area along line 5-5 of FIG. 1.
Figure 6:
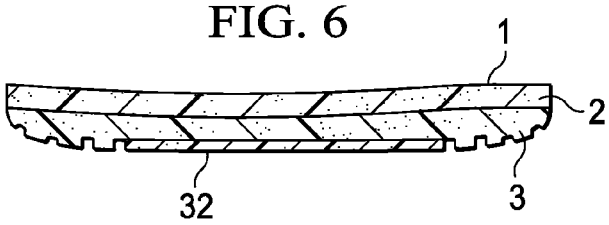
FIG. 6 is a cross-sectional view near the metatarsal area line 6-6 of FIG. 1.
Figure 4A:
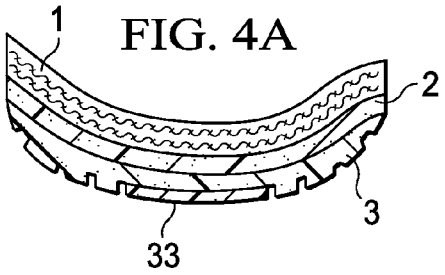
Figure 5A:
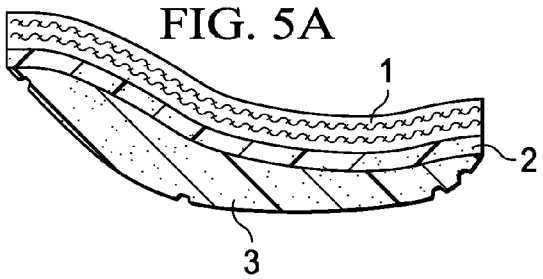
Figure 6A:
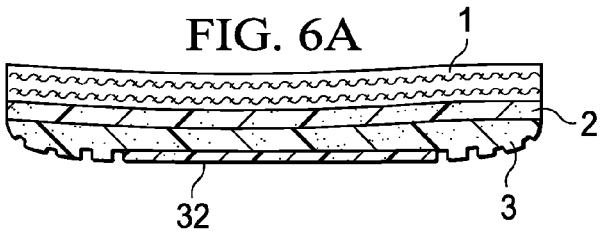

FIGS. 4, 5, and 6 and FIGS. 4A, 5A and 6A show cross-sections of the insole at lines 4-4, 5-5 and 6-6 of FIG.1 respectively. When compared one to another, the change in shape (both curve and thickness) at different sections of the insole can be seen. The thickness is typically much greater in the arch area of the foot as shown in FIGS. 5 and 5A. The height of the arch support area (34) mentioned above is best shown in FIGS. 5 and 5A. The cup or dented shape of the heel area (35) is best shown in FIGS. 4 and 4A. The figures designated with "A" show a thicker foam layer as the top layer as compared with the figures without the "A" which illustrate a thin cloth or foam layer as top layer (1).

Figure 7:
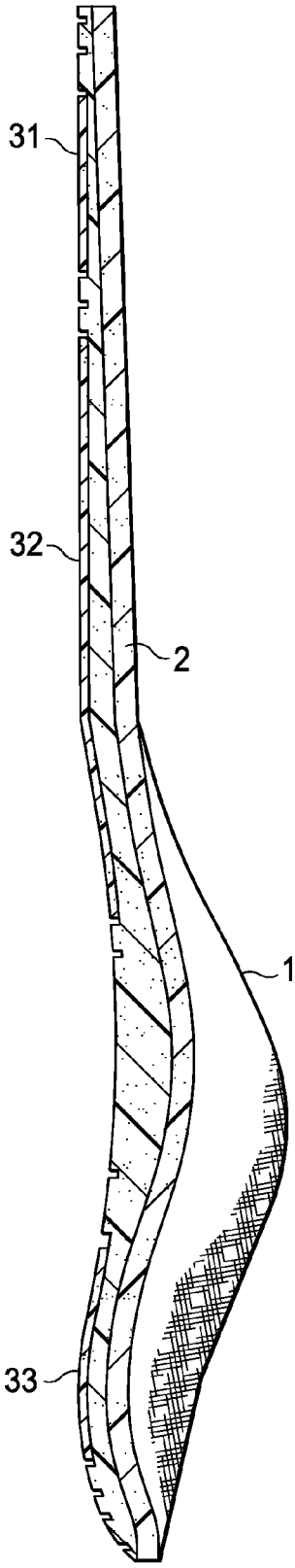
FIG. 7 is a cross-sectional view along line 7-7 of FIG. 1
Figure 7A:
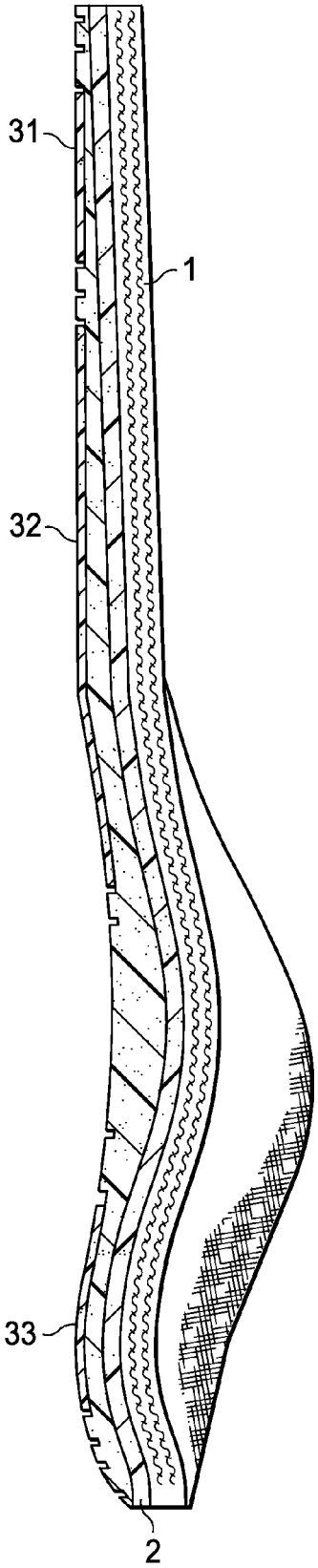

FIG. 7 and FIG. 7A show a cross section of the insole of FIG. 1 along line 7-7. FIG. 7 illustrates a thinner top layer(1) and FIG. 7A a thicker top layer(1) as discussed above. The positioning of inserts 31, 32 and 33 and the indentations in which they lie is best seen in this figure as is the contour of the various components of the insole.

Figure 8:
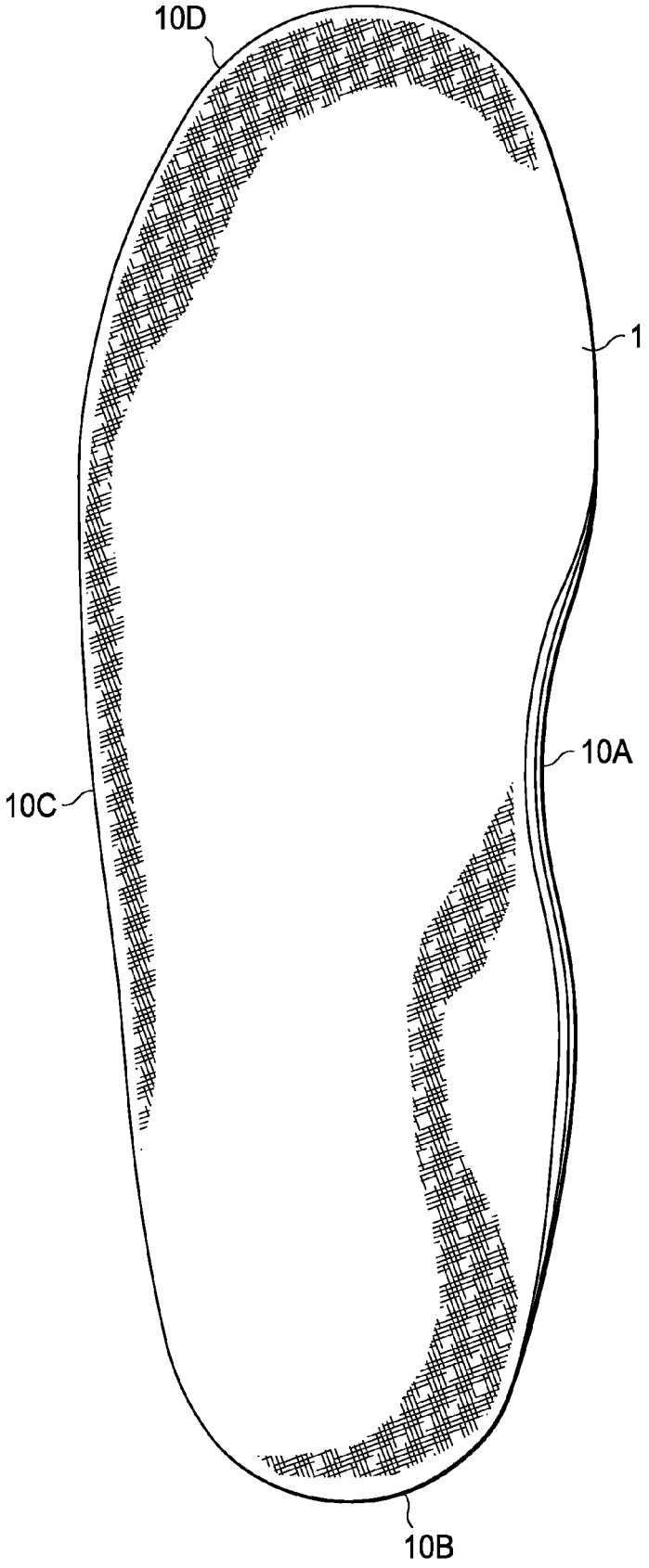
FIG. 8 is a top view of the insole of FIG. 1

FIG. 8 illustrates a top view of the insole of FIG. 1. Top layer (1) is visible as well as well as outline (10) inner outline region (10A) , outer outline region (10C), heel outline region (10B) and toe outline region (10D)

We claim:

1. An insole for arthritic or diabetic patients, comprising:

a generally foot-shaped bottom layer having a length extending from a heel area to a toe area, a top surface and a bottom surface wherein said bottom layer is integrally formed in a shape comprising a raised arch support area and a heel-receiving cup area;

a first indentation integrally formed in the bottom surface of the bottom layer without extending through the entire bottom layer, said first indentation positioned centrally in a toe region extending substantially an entire lateral width of the bottom surface of the toe region;

a second indentation integrally formed in the bottom surface of the bottom layer without extending through the entire bottom layer, said second indentation positioned centrally in a metatarsal region extending substantially an entire lateral width of the bottom surface in that metatarsal region and extending from a lower toe region to a portion of an arch area of the insole;

a third indentation integrally formed in the bottom surface of the bottom layer without extending through an entire bottom layer, said third indentation positioned centrally in a heel region;

each of said first, second, and third indentations formed to receive an insert layer that is coupled to the bottom surface of bottom layer in the first, second or third indentations;

a synthetic rubber layer having first and second sides, said second side coextensive with and secured to said top surface of said bottom layer; and a top layer coextensive with and secured to said first side of said synthetic rubber layer.

2. The insole of claim 1, further comprising one or more insert layers secured to said indentations.

3. The insole of claim 1, wherein said synthetic rubber layer is a polymer of polychloroprene.

4. The insole of claim 2, wherein said synthetic rubber layer is a polymer of polychloroprene.

5. The insole of claim 2, wherein said inserts comprise a textured material which is softer than the material of the bottom layer.

6. The insole of claim 5, wherein said bottom layer comprises EVA.

7. The insole of claim 1, wherein said top layer is a sheet of fabric.

8. The insole of claim 1, wherein said top layer is polyethylene foam.

9. The insole of claim 8, wherein said top layer is about 2 mm thick.

10. The insole of claim 1, wherein said top layer is closed cell cross-linked foam material.

11. The insole of claim 10, wherein said foam material is from about 2.5 mm to from about 3.8 mm, preferably about 3.2 mm thick.

12. The insole of claim 11, wherein said foam material is about 3.2 mm thick.

13. An insole for arthritic patients, comprising:

(a) a generally foot-shaped bottom layer having a length extending from a heel area to a toe area, a top surface and a bottom surface wherein said bottom layer is integrally formed in a shape comprising an arch support area and a heel-receiving cup area wherein said bottom surface further comprises a first indentation, a second indentation and a third indentation formed integrally therein, said indentations adapted to receive an insert layer, and an insert layer secured to each of said indentations;

the first indentation integrally formed in the bottom surface of the bottom layer without extending through the entire bottom layer, said first indentation positioned centrally in a toe region extending substantially an entire lateral width of the bottom surface of the toe region;

the second indentation integrally formed in the bottom surface of the bottom layer without extending through the entire bottom layer, said second indentation positioned centrally in a metatarsal region extending substantially an entire lateral width of the bottom surface in that metatarsal region and extending from a lower toe region to a portion of an arch area of the insole;

the third indentation integrally formed in the bottom surface of the bottom layer without extending through an entire bottom layer, said third indentation positioned centrally in a heel region;

(b) a synthetic rubber layer having first and second sides, said second side coextensive with and secured to said top surface of said bottom layer; and (c) a top layer coextensive with and secured to said first side of said synthetic rubber layer.

14. The insole of claim 13, wherein said bottom layer comprises EVA.

15. The insole of claim 13, wherein said top layer is a polyethylene foam.

16. The insole of claim 13, wherein said top layer is cloth.

17. The insole of claim 13, wherein said top layer is closed cell cross-linked foam material.

* * * * *

UNITED STATES PATENT AND TRADEMARK OFFICE

CERTIFICATE OF CORRECTION

PATENT NO. : 8,424,222 B2
APPLICATION NO. : 12/672260
DATED : April 23, 2013
INVENTOR(S) : Duane M. Sulak, David B. Granger and Jacob Martinez It is certified that error appears in the above-identified patent and that said Letters Patent is hereby corrected as shown below:

Title Page

Delete Title Page, and replace with new Title Page (Attached)

In the Specification

Col. 4, line 54, replace "as well as well as outline" with --as well as outline--
Col. 4, line 56, insert --.--

In the Claims

Col. 5, lines 34-35, delete "7. The insole of claim 1, wherein said top layer is a sheet of fabric."
Col. 5, lines 36-37, delete "8. The insole of claim 1, wherein said top layer is polyethylene foam."
Col. 5, lines 38-39, delete "9. The insole of claim 13, wherein said top layer is about 2 mm thick."

Signed and Sealed this
Fourteenth Day of April, 2015

Michelle K. Lee

Michelle K. Lee
*Director of the United States Patent and Trademark Office*

(12) United States Patent
Sulak et al.

(10) Patent No.: US 8,424,222 B2
(45) Date of Patent: Apr. 23, 2013

(54) ARTHRITIS AND DIABETES INSOLE

(75) Inventors: Duane M. Sulak, Waco, TX (US); David B. Granger, Lorena, TX (US); Jacob Martinez, Temple, TX (US)

(73) Assignee: Spenco Medical Corporation, Waco, TX (US)

( * ) Notice: Subject to any disclaimer, the term of this patent is extended or adjusted under 35 U.S.C. 154(b) by 582 days.

(21) Appl. No.: 12/672,260

(22) PCT Filed: Nov. 21, 2008

(86) PCT No.: PCT/US2008/084280

§ 371 (c)(1),
(2), (4) Date: Feb. 4, 2010

(87) PCT Pub. No.: WO2009/067643

PCT Pub. Date: May 28, 2009

(65) Prior Publication Data

US 2011/0219642 A1 Sep. 15, 2011

Related U.S. Application Data

(60) Provisional application No. 60/989,767, filed on Nov. 21, 2007.

(51) Int. Cl.
*A43B 13/38* (2006.01)

(52) U.S. Cl.
USPC ..... 36/44; 36/174; 36/178; 36/181

(58) Field of Classification Search ..... 36/44, 174, 36/178, 181, 28, 43, 145, 166, 173, 91
See application file for complete search history.

(56) References Cited

U.S. PATENT DOCUMENTS

| | | | | |
|---|---|---|---|---|
| 4,413,429 | A * | 11/1983 | Power | 36/44 |
| 4,887,368 | A * | 12/1989 | Latzke | 607/111 |
| 6,176,025 | B1 * | 1/2001 | Patterson et al. | 36/28 |
| 6,453,578 | B1 | 9/2002 | Yung et al. | |
| 6,481,120 | B1 | 11/2002 | Xia et al. | |

(Continued)

FOREIGN PATENT DOCUMENTS

| | | |
|---|---|---|
| KR | 10-0641278 | 11/2006 |
| KR | 10-0736813 | 7/2007 |

*Primary Examiner* — Ted Kavanaugh
(74) *Attorney, Agent, or Firm* — Hemingway & Hansen, LLP; D. Scott Hemingway

(57) ABSTRACT

An insole especially advantageous for arthritic or diabetic patients comprises three layers and is shaped in a form which provides and arch support and an integral heel receiving area. It is made from a generally foot-shaped bottom layer having a length extending from a heel area to a toe area, a top surface and a bottom surface. The bottom surface of the bottom layer preferably further comprises one to three indentations formed integrally therein. Insert layers are secured to each of said indentations. Preferably, the bottom layer is made from an EVA foam. A middle layer having a first and second side is secured to the top surface of the bottom layer adjacent the middle layer's second side. The middle layer is preferably made of a synthetic rubber layer. The middle layer takes the shape of the bottom layer. A top layer is coextensive with and secured to the first side of the synthetic rubber layer. The top layer composition is selected according to the intended use. In use, the foot of the wearer, with or without a sock or stocking thereon, rests upon the top layer in the foot-receiving compartment of the shoe.

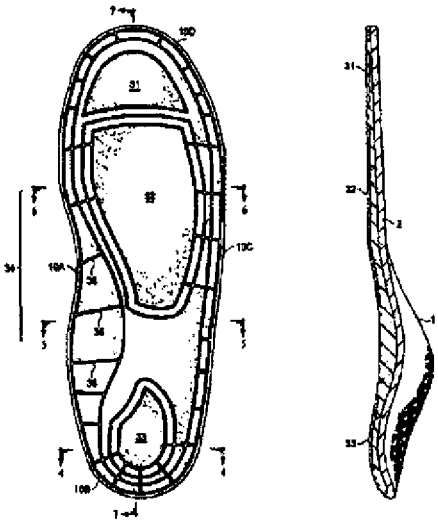

14 Claims, 6 Drawing Sheets